US007175263B2

(12) United States Patent
Colombat et al.

(10) Patent No.: US 7,175,263 B2
(45) Date of Patent: Feb. 13, 2007

(54) CONVERGING AXIS DUAL-NOZZLED PRINT HEAD AND PRINTER FITTED THEREWITH

(75) Inventors: Thierry Colombat, La Voulte S/Rhone (FR); Paul Bajeux, Chatuzange le Goubet (FR)

(73) Assignee: IMAJE SA, Bourg les Valence Cedex (FR)

( * ) Notice: Subject to any disclaimer, the term of this patent is extended or adjusted under 35 U.S.C. 154(b) by 258 days.

(21) Appl. No.: 10/500,989

(22) PCT Filed: Jan. 24, 2003

(86) PCT No.: PCT/FR03/00234

§ 371 (c)(1),
(2), (4) Date: Jul. 2, 2004

(87) PCT Pub. No.: WO03/064162

PCT Pub. Date: Aug. 7, 2003

(65) Prior Publication Data

US 2005/0122381 A1 Jun. 9, 2005

(30) Foreign Application Priority Data

Jan. 28, 2002 (FR) ..... 02 00980

(51) Int. Cl.
*B41J 2/09* (2006.01)
*B41J 2/105* (2006.01)

(52) U.S. Cl. ..... 347/77; 347/82

(58) Field of Classification Search ..... 347/77, 347/82
See application file for complete search history.

(56) References Cited

U.S. PATENT DOCUMENTS 3,596,276 A * 7/1971 Lovelady et al. ..... 347/76
3,761,953 A * 9/1973 Helgeson et al. ..... 347/7

(Continued)

FOREIGN PATENT DOCUMENTS

DE 34 16 449 A1 2/1985

(Continued)

OTHER PUBLICATIONS

Patent Abstracts of Japan, Aiba Masahiko, "Ink Jet Printer", Publication No. 60193659, Publication Date: Oct. 2, 1985, 1 page.

(Continued)

*Primary Examiner*—Stephen Meier
*Assistant Examiner*—Rene Garcia, Jr.
(74) *Attorney, Agent, or Firm*—Pearne & Gordon LLP

(57) ABSTRACT

A twin-nozzle print head for a continuous inkjet deflection printer comprises an ink drop generator assembly having two inkjet ejection nozzles, each of the nozzles having an ejection axis. Charge electrodes, deflection electrodes deflecting charged drops and a single ink drop recovery gutter for both nozzles are also provided. The ejection axes of nozzles converge at a point located on an axis of a single inlet orifice of the single recovery gutter in the vicinity of this orifice or upstream of this gutter. A printer equipped with this head prints swathes of large width with good juncture.

20 Claims, 6 Drawing Sheets

U.S. PATENT DOCUMENTS

| | | | | | |
|---|---|---|---|---|---|
| 3,848,258 | A | | 11/1974 | Mahoney et al. | |
| 3,955,203 | A | | 5/1976 | Chocholaty | |
| 4,338,613 | A | * | 7/1982 | Cruz-Uribe | 347/82 |
| 4,375,062 | A | * | 2/1983 | Sturm | 347/21 |
| 4,381,513 | A | * | 4/1983 | Ebi et al. | 347/77 |
| 4,395,716 | A | * | 7/1983 | Crean et al. | 347/76 |
| 4,470,052 | A | * | 9/1984 | Lovelady | 347/80 |
| 4,551,731 | A | * | 11/1985 | Lewis et al. | 347/78 |
| 4,596,990 | A | * | 6/1986 | Hou | 347/41 |
| 4,695,848 | A | * | 9/1987 | Padalino | 347/80 |
| 4,703,330 | A | | 10/1987 | Culpepper | |
| 4,990,932 | A | * | 2/1991 | Houston | 347/81 |
| 5,410,342 | A | * | 4/1995 | Lecheheb et al. | 347/77 |
| 5,457,484 | A | | 10/1995 | Regnault et al. | |
| 6,758,555 | B2 | * | 7/2004 | Bajeux | 347/77 |

FOREIGN PATENT DOCUMENTS

| | | | | |
|---|---|---|---|---|
| EP | 0036789 | A1 | * | 9/1981 |
| JP | 56058874 | A | * | 5/1981 |
| WO | WO91/05663 | | | 5/1991 |
| WO | WO91/11327 | | | 8/1991 |

OTHER PUBLICATIONS

Patent Abstracts of Japan, Miroku Yoshihiko, "Charged Electrode on Ink Jet Printer", Publication No. 6219661, Publication Date: Jul. 25, 1987, 1 page.

Patent Abstracts of Japan, Tatemachi Hiroji, "Ink Jet Recording Head", Publication No. 05309836, Publication Date: Nov. 22, 1993, 1 page.

Patent Abstracts of Japan, Tanuma Chiaki, "Ink Jet Recording Apparatus", Publication No. 08244238, Publication Date: Sep. 24, 1996, 1 page.

* cited by examiner

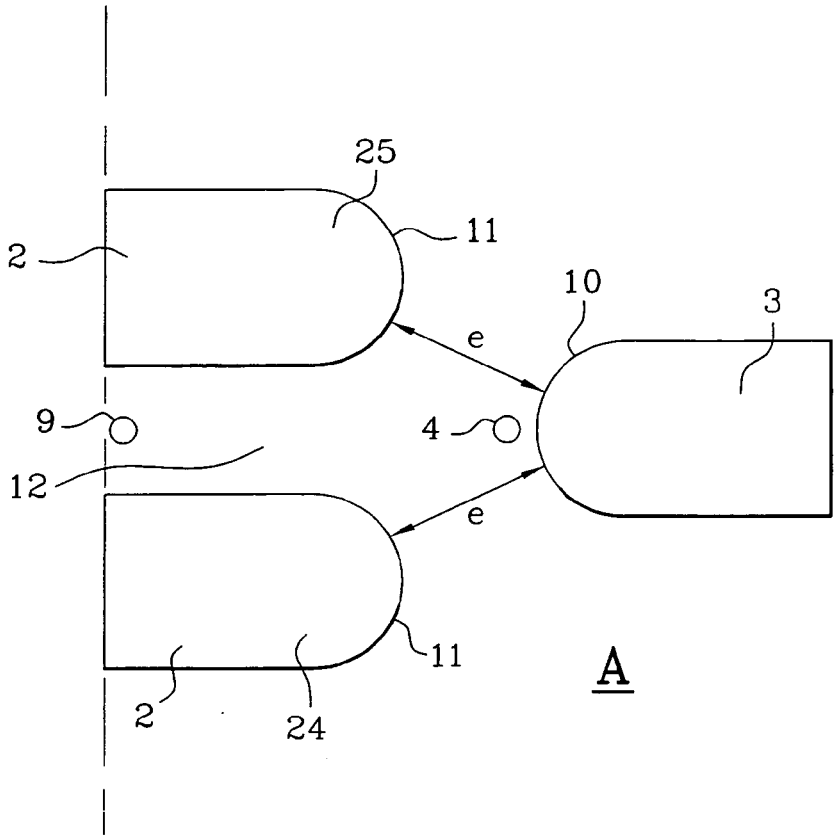
Fig. 6
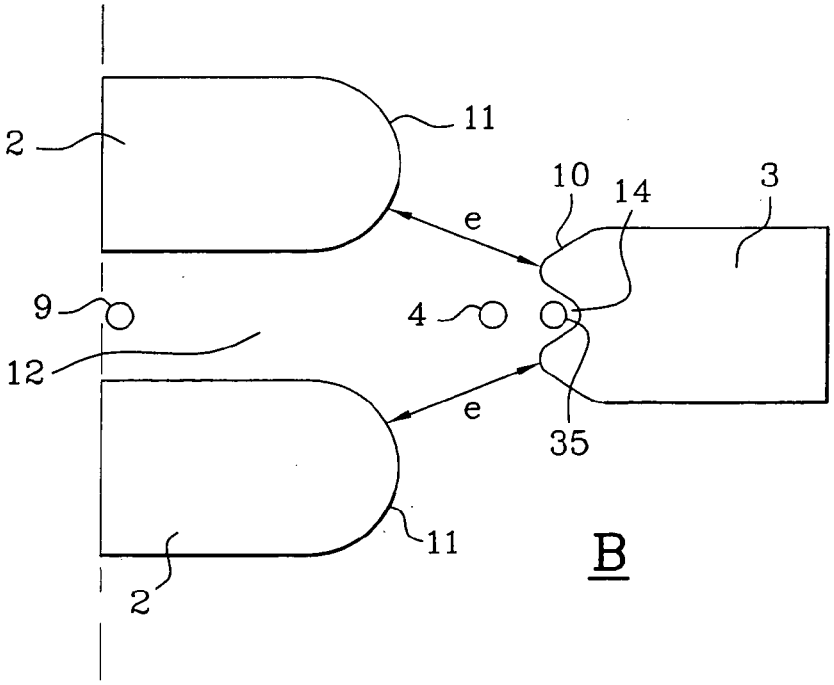

CONVERGING AXIS DUAL-NOZZLED PRINT HEAD AND PRINTER FITTED THEREWITH

TECHNICAL FIELD

The present invention pertains to the area of print heads for continuous inkjet deflection printers. More particularly, it concerns an improved print head comprising two ink ejection nozzles. It also relates to an inkjet printer equipped with this improved head.

TECHNOLOGICAL BACKGROUND

Inkjet printers fall into two major technological families, a first family consisting of "drop-on-demand" printers and a second consisting of continuous jet printers.

"Drop-on-demand" printers are generally office printers, designed for printing text and graphic patterns in black or colour on sheet substrates.

"Drop-on-demand" printers directly and solely generate those ink drops effectively required for printing desired patterns. The print head of these printers comprises a plurality of ink ejection nozzles, usually aligned along a nozzle alignment axis and each addressing a single point of the print medium. When the ejection nozzles are in sufficient number, printing is obtained by simple movement of the print medium under the head, perpendicular to the nozzle alignment axis. If not in sufficient number, additional scanning of the medium relative to the print head is essential.

Continuous inkjet printers are generally used for industrial marking and coding applications.

The typical functioning of a continuous inkjet printer can be described as follows. Electrically conductive ink maintained under pressure escapes from a calibrated nozzle to form an inkjet. Under the action of a periodic stimulation device, the inkjet so formed breaks up at regular time intervals at a single point in space. This forced break-up of the inkjet is usually induced at a so-called jet break-off point by periodic vibrations of a piezoelectric crystal placed in the ink upstream from the nozzle. After break-off, the continuous jet turns into a succession of identical, regularly spaced ink drops. In the vicinity of the break-off point is a first group of electrodes called "charge electrodes" whose function is to transfer selectively and to each of the drops a predetermined quantity of electric charge. All the jet drops then pass through a second arrangement of electrodes called "deflection electrodes" forming an electric field which modifies the pathway of the charged drops.

In a first variant of so-called continuous inkjet deflection printers, the quantity of charge transferred to the ink drops is variable and each drop records a deflection proportional to the electric charge previously allocated to it. The point of the print medium reached by a drop depends upon this electric charge. Non-deflected drops are recovered by a gutter and recycled towards an ink circuit.

It is also known to persons skilled in the art that a specific device is required to ensure constant synchronization between jet break-off times and application of charge signals to the drops. It is to be noted that this technology, through its multiple levels of deflection, enables a single nozzle to print the entirety of a pattern in successive swathes, i.e. in lines of points of given width. Passing from one swathe to another is made via relative continuous movement of the substrate relative to the print head, perpendicular to said swathes. For applications requiring slightly wider printing width than the width of a single swathe, several single-nozzle print heads, typically 2 to 8, may be grouped within one same casing.

A second variant of continuous inkjet printers called binary continuous inkjet printers, sets itself apart from the previous variant chiefly through the fact that only one level of drop deflection is created. The printing of characters or patterns therefore requires the use of multi-nozzle print heads. The centre-to-centre distance of the nozzles coincides with the centre-to-centre distance of the impacts on the print medium. It is to be noted that in general the drops intended for printing are non-deflected drops. Binary continuous inkjet printers are intended for high speed printing applications such as addressing or personalizing of documents.

It is to be emphasized that the continuous inkjet technique requires ink pressurization, thereby allowing a print throw, i.e. the distance between the lower face of the print head and the print medium, possibly reaching 20 mm, i.e. ten to twenty times greater than the print distances of drop-on-demand printers.

The addressability of a continuous inkjet printer is the number of separate impacts per unit width of a printed swathee. For example, a single-nozzle continuous inkjet deflection printer equipped with a nozzle having a diameter of 50 micrometers, provides approximately 5 impacts per millimetre. The number of impacts in a swathee is in the order of 25. Under these conditions the maximum width of a swathe is typically 5 mm at usual printing distances.

For the same print quality, numerous applications require a slightly greater printing width, up to 10 mm under the conditions of the above-cited example.

One known solution to achieve such swathe widths consists of the binary continuous jet multi-nozzle print head briefly described above. These machines are rapid and enable swathe widths ranging up to 50 mm. For print quality similar to that of continuous inkjet deflection printers however a nozzle plate is required whose tolerances on the ink ejection orifices are very tight. Any difference in the diameter of the orifices translates as a different drop volume which in turn translates as a different size of drop impact. Tolerances for spacing and directionality of the orifices are also very tight since they determine the accuracy of the impact position.

It is also necessary to provide for a jet stimulation device enabling equal break-off distances for each jet. Said condition is difficult to implement in particular for jets from the end nozzles of the nozzle plate.

Design and manufacturing constraints in particular for nozzle plates and stimulation devices give rise to costs associated with binary continuous jet multi-nozzle heads, per print width unit, which largely exceed those associated with deflection continuous jet heads. Also if due heed is not given to these constraints, printing is of lesser quality.

Another known solution incorporates two nozzles in one same casing each nozzle ejecting an inkjet used according to the deflection continuous jet technique.

One first example of this solution is given in patent application WO 91/05663 (U.S. Pat. No. 5,457,484) in the name of the applicant. The head described in this application comprises two single-nozzle print heads mounted on one same support. Advantageously, there is only one ink recovery module with only one return channel for the two heads. The geometry of the heads, in particular the relative angle of the axes of the nozzles, and the deflection voltages of the drops derived from each of the two heads are adjusted to obtain juncture of the swathes printed by each of the two heads on the print medium, so that a single swathe is obtained having twice the width of the one obtained with only one head.

Juncture of two swathes is obtained by juxtaposing on the print medium the impact of the most deflected drop from one head with the impact of the least deflected drop from the other head, so that these two drops are positioned relative to one another as if they were two spatially consecutive drops from one same head. Precise juncture with no visible defect is difficult to achieve since the pathway and hence the point of impact of the most deflected drop is highly sensitive to aerodynamic and electrostatic disturbances set up in particular by the presence of other drops. In this embodiment, any change made to the volume of the formed drops will require review of the geometry of the printhead. One first reason derives from the fact that the pathway of a charged drop, especially the pathway of a highly charged drop such as the most deflected drop, varies in relation to the ratio between the electric charge and drop volume. It follows that the pathways of drops of different diameters are not identical. In particular, the impact points of the most deflected drops of different diameters will not be identical. A second reason derives from the fact that the maximum electric charge which can be applied to an ink drop depends upon its diameter. This means that one cannot simply compensate for a variation in drop volume by a variation in electric charge to obtain the same deflection. On this account, to achieve good juncture between the swathes formed by each of the heads, the geometry of the multi-nozzle head must be adapted to drop volume. Similarly, any difference in diameter of the orifices translates as different drop volumes which, for the same charge, has an influence on their deflection and hence on the accuracy of the impact on the substrate and consequently on juncture.

A second embodiment in which two nozzles are incorporated in one same casing, both nozzles each ejecting an inkjet treated according to the deflection continuous jet technique, is described in patent application WO 91/11327.

In the device described in this application the two heads may benefit from common structures such as the ink reservoir, the vibrator used to break up the jet into drops, and a central drop deflection electrode. The jets ejected from the two nozzles are parallel to one another. It is to be noted as is shown in FIG. 1 of this application that the plane defined by the axes of the jets is perpendicular to the plane containing the pathways of drops deflected by the deflection electrodes. As a result, if no special precautions are taken as explained hereafter, the two swathes do not lie within the extension of one another. The consecutive drops the closest to one another in each of the swathes which can be traced by one of the heads, i.e. the juncture drops of the two swathes, are the least deflected drops of each of the two swathes. Which means that this two-nozzle head does not have the same disadvantages as the first two-nozzle head for example. Since it uses common members it can be produced at less cost. A change in the diameter of the nozzles does not require adjustment of the direction of the nozzle axes to ensure juncture of the swathes.

This second embodiment has other disadvantages however. Firstly, as mentioned above, since the nozzle axes are parallel to one another and since the plane defined by the jet axes is perpendicular to the plane containing the drop pathways, it follows that the swathes traced by each of the jets when the medium is immobile are swathes parallel to one another. The distance between the straight lines carrying these two swathes is substantially equal to distance d separating the nozzle axes from each of the heads. During normal operation it was seen above that the heads and the medium have relative movement along a direction perpendicular to the swathes. Consequently, for the swathes traced by each of the heads to lie within the extension of one another, consideration must be given to distance d, to the speed of travel of the medium and to the flight time of the drops between their ejection and impact, in order to adjust delay between drop ejection times by each of the heads. This fact is not mentioned in the description of this second example other than in a passage on page 3 lines 16–18 where it is indicated that the electronic control circuits are within the reach of persons skilled in the art and will therefore not be described. Adjustment of the delay between the drops from each of the nozzles therefore assumes a specific circuit to manage this delay. Even if such circuit includes good servo-control of the delay relative to the speed of travel of the substrate, the joining of the swathes will continue to fluctuate on account of variations in travel speed and/or mechanical tension of the substrate and/or drop velocity over time leading to corresponding variations in drop position.

Other disadvantages are common to the heads of the first and second embodiments described above.

BRIEF DESCRIPTION OF THE INVENTION

Compared with the prior art just described, the objective of the present invention is to produce a printhead for a deflection continuous inkjet printer having two ejection nozzles and therefore able to print a swathe twice the length of one printed by a single-nozzle head, but which also provides good juncture quality while using simplified electronic control circuits.

In addition, the print heads of the invention may have common geometry irrespective of drop volume. By this it is meant that the centre-to-centre distance between nozzles may remain constant over a wide range of drop volumes. Similarly, the form and size of the drop generators for heads designed for different ink drop volumes may remain identical. It follows that such heads designed for different ink drop volumes have generator bodies which only differ through the characteristics of the vibrator or the nozzle diameters of the nozzle plate.

It will be seen below that if the total width of the swathe to be printed using the two nozzles is less than twice the maximum width of the swathes printed by a single nozzle, then printing speed may be increased.

Also, in a twin-nozzle head of the invention, printing of the medium by drops forming the two parts of one same swathe is substantially simultaneous, so that the possibility arises of using much simpler electronic circuits to adjust drop pathway.

These objectives are reached through the fact that in the two-nozzle print head of the invention, the drops contributing towards the joining of the two swathes as described in document WO 91.11327, are the non-deflected drops or the least deflected drops. On this account, the joining remains of good quality even if the volume of the drops changes. In addition, the nozzle axes converge and a single orifice of a single recovery gutter is positioned at the point of convergence between these axes or downstream from this convergence point. The single recovery gutter of the head of the invention differs from single gutters of the prior art in that the recovery orifice is also a single orifice. On this account the recovery gutter requires less space. Also, since the ink is drawn from a single orifice, there is no loss of pressure at the channel between two openings. Aspiration is therefore of better quality which facilitates cleaning when not in service. This reduces the probability of having dried ink in the channel between orifices.

The invention therefore relates to a twin-nozzle printhead for a deflection continuous inkjet printer, the head comprising:

an ink drop generating assembly having two inkjet ejection nozzles, each of the nozzles having an axis, and arranged along this axis:

charge electrodes, first and second deflection electrodes deflecting charged drops, these electrodes each having relative to the nozzles an upstream part and a downstream part, an active surface of each electrode being a surface of said deflection electrode which lies opposite a succession of drops;

a single gutter for both nozzles to recover ink drops, characterized in that the nozzle axes converge at a point located on an axis of single inlet orifice of the single recovery gutter in the vicinity of this orifice or upstream from this gutter.

The converging point of the nozzle axes is always located on the axis of the gutter orifice. It is specified that this axis is formed by a straight line common to the plane of the nozzle axes and a plane perpendicular to this plane containing the bisector of the angle formed by said nozzle axes. The single orifice of the gutter of a print head according to the invention is evidently located at a converging point of the pathways of non-printable drops, i.e. those drops which are not directed towards a print medium. When all drops are deflected drops, including non-printable drops, the converging point of the nozzle axes is located upstream from the centre of the orifice. When the non-printable drops are non-deflected drops, which is the most general case, it can be considered that the pathways of the drops with high velocity are straight lines, and therefore the converging point of the pathways of the non-printable drops derived from each of the nozzles coincides with the centre of the single orifice of the recovery gutter. Having regard to manufacturing tolerances, this converging point is located in this case in the vicinity of the centre of this orifice.

In one advantageous embodiment of the invention, the deflection electrodes are arranged in a reduced space leading to reduced volume take-up by the print-head in a printer in which this head is incorporated.

In this advantageous embodiment, deflection performance is obtained with significantly reduced voltage compared with usual supply voltages for equipotential deflection electrodes, thus facilitating the integration of said electrodes and of a generator of said reduced voltage in a print head.

A further subject of a variant of this advantageous embodiment is to significantly reduce the risk of accidental ink spraying, during jet starts and stops, onto an active surface of the deflection electrodes.

The deflection electrodes each have, relative to a jet ejection nozzle, both an upstream part and a downstream part. An active surface of each deflection electrode is a surface of said electrode which lies opposite a succession of drops. In the advantageous embodiment, the deflection electrodes for jet drops comprise two electrodes, a first and a second. The active surface of the first electrode has a first concave longitudinal curvature whose local radius of longitudinal curvature, at every point of the curve, is located in a plane defined by the converging axes of the nozzles. This plane of the nozzle axes also contains a direction of drop deflection. The active surface of the second electrode has a first convex longitudinal curvature whose local curvature radius, at every point of the curve, is also contained in the plane of the nozzle axes. Also, the first electrode in its downstream part has a recess with a contour.

It will now be specified what is meant by downstream part. The function of the recess is to allow the passing of non-deflected or scarcely deflected drops through the first electrode. Non-deflected drops substantially follow a pathway which, at first approximation, may be considered as rectilinear. The result is that the part that is most upstream of the recess contour is located in the immediate vicinity and slightly upstream from the point of intersection of the first electrode with the axis of the jet. The part most upstream of the recess contour must therefore be located at sufficient distance from the point of intersection of the first electrode with the jet axis for a non-deflected drop to be able to pass through the recess of the electrode with near zero probability of intercepting the electrode.

The drops that are slightly charged and therefore slightly deflected have a pathway whose curvature may be smaller than that of the first electrode. The pathway of the slightly deflected drops is therefore likely to be secant to the active surface of the first electrode. The recess must be such that it allows the passage of these scarcely deflected drops. The possible point of intersection between the pathway of a scarcely deflected drop and the surface of the electrode before the recess is necessarily positioned downstream from the point defined above as being the point the most upstream from the recess. It can therefore be considered that the downstream part of the first electrode is a part of this electrode positioned downstream from the point of intersection of the electrode with the axis of the jets.

Given the function of the recess it can be understood that the shape of this recess will have, as line of symmetry, a line defined by the intersection of the electrode before the recess, with a plane containing the axis of the jets and the direction of drop deflection. The recess will therefore have an oblong shape centred on the above-defined line of symmetry.

The width of the recess arises from a compromise between two requirements: to allow the drops to pass through the first electrode with no risk of collision between the drop and the electrode, which requires a wide recess, and to limit reduction of the inter-electrode field which requires a narrow recess.

The diameter of the ink drops is in the order of a few dozen μm, typically lying between 30 and 140 μm, for example 100 μm.

The width of the recess measured perpendicular to the line of symmetry is greater than the diameter of the drops and ideally in the order of two to three times the diameter of the drops, i.e. typically 200 to 300 μm. However, to be sure of avoiding collisions between drops and the first electrode it may be necessary to fix a width in the order of 8 to 10 times drop diameter.

Therefore the embodiments of the deflection electrodes according to the advantageous embodiment of the invention may, either together or separately, have the following characteristics.

The curvature of the second electrode is such that the active surface of this second electrode is substantially parallel to that of the first electrode so that the two active surfaces have a substantially constant gap e between one another.

The recess contour has a most upstream point located in the vicinity of the intersection before recess of the first electrode with the axis of the ink jet.

The recess has symmetry relative to a plane containing the axis of the ink jet.

The width of the recess lies between two (2) and ten (10) times the diameter of the ink drops.

The recess is in the form of an oblong slit of which one opening leads to the most downstream part of the first electrode.

The space between the active surfaces of the two electrodes is substantially constant from upstream to downstream of the electrodes and lies between 4 and 20 times the diameter of the ink drops, i.e. around 0.5 to 3 mm. This substantially constant spacing is a function of the value of the deflection field it is desired to achieve, this field resulting from the distance between the electrodes and the potential difference between the two electrodes.

One edge situated the most downstream of the first electrode is more downstream than a surface that is most downstream of the recovery gutter.

The second electrode, on its active surface, is provided with a groove traced along an axis contained in the plane containing the jet axis.

One bottom of the groove is joined to the active surface of the second electrode by a surface curved transversally along curve radii of greater value than the radius of the ink drops.

Tongues of the first electrode formed either side of the recess and the second electrode are curved transversally along curve radii of greater value than the radius of the ink drops.

In the preferred embodiment of this advantageous embodiment the first deflection electrodes allocated to the jet of each of the nozzles consist of a mechanically single part having a plane of symmetry. This plane of symmetry is a plane perpendicular to the plane defined by the axes of the two nozzles and containing the bisector of the angle formed by these two axes.

BRIEF DESCRIPTION OF THE DRAWINGS

An example of embodiment and variants, and the functioning of a print head having the characteristics of the invention are described below with reference to the appended drawings. In these drawings parts having the same reference number or the same reference number followed by a sign "'" have the same function. In the drawings:

FIG. 5 part A is a front semi-view of electrostatic deflection electrodes according to the advantageous embodiment of the deflection electrodes. FIG. 5 part B is a left-side view of the schematic given in FIG. 5 part A, and FIG. 5 part C is a front semi-view of electrostatic deflection electrodes comprising two central electrodes;

FIG. 6 comprises part A and part B. Parts A and B each show a semi cross-section view of electrostatic deflection electrodes according to a variant of the advantageous embodiment of the deflection electrodes;

DESCRIPTION OF EXAMPLES OF EMBODIMENT

Figure 1:
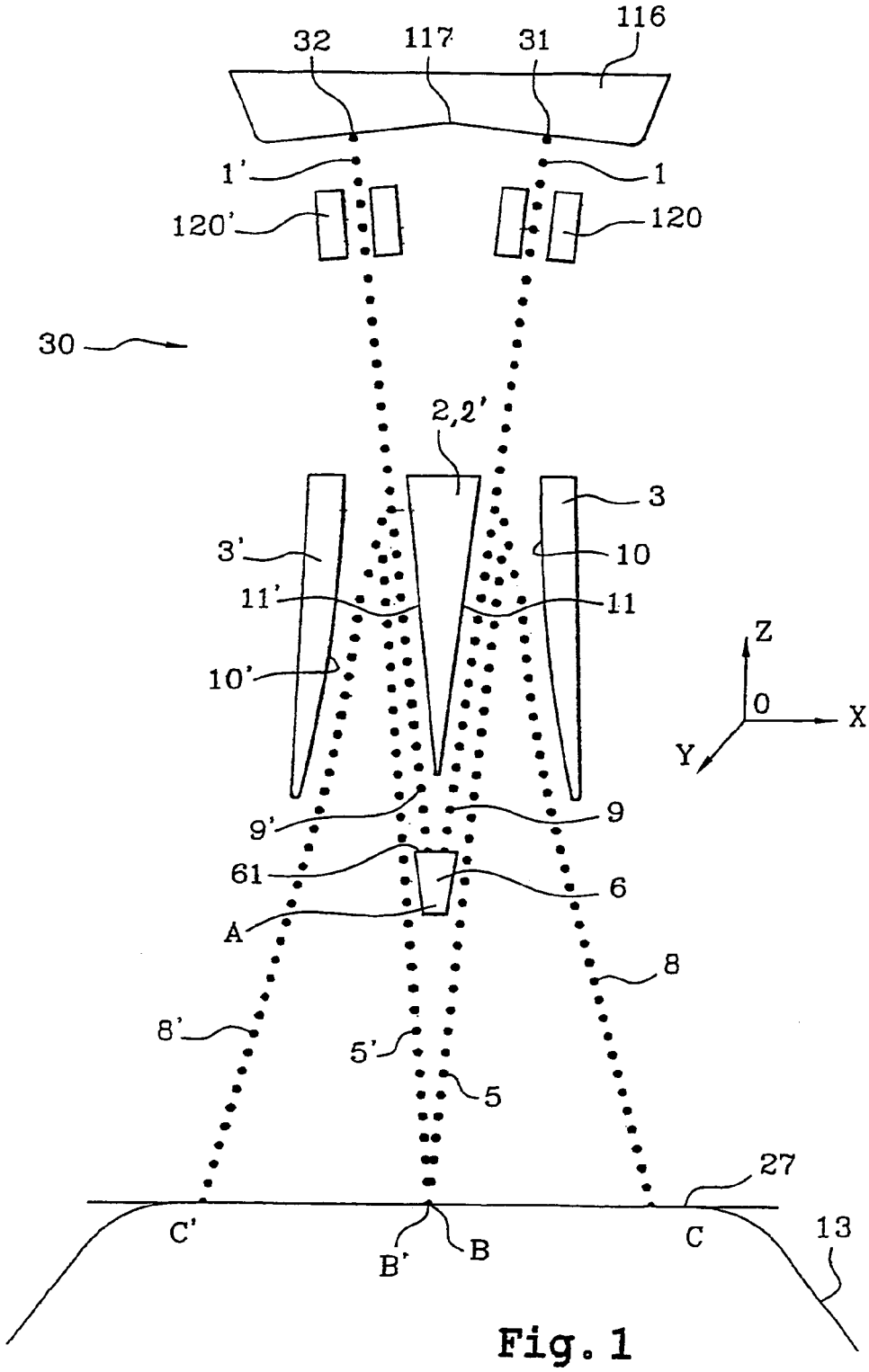
FIG. 1 is a schematic of a first embodiment of a twin-nozzle print-head of the invention, this embodiment only comprising a single jet generation chamber.

FIG. 1 is a schematic of a twin-nozzle print-head 30 according to the invention.

In known manner, the head comprises a generator 116 to generate ink drops. Drop generator 166, from electrically conductive ink contained under pressure in a generator chamber 116, forms two ink jets. Each ink jet is fractionated into a succession of drops, for example by means of one or two vibrators housed in the chamber. The drops are electrically charged in a selective fashion by electrodes 120, 120' through which each jet passes and which are supplied by a voltage generator not shown. The charged drops of each jet pass through a space lying between two deflection electrodes 2, 3; 2',3'. Depending upon their charge, they are deflected to greater or lesser extent. The drops that are not or are least deflected are directed towards an ink recovery gutter 6 while the other deflected drops are directed towards a substrate 27 carried locally by a support 13. The successive drops of a burst reaching substrate 27 can therefore be deflected towards an extreme low position, an extreme high position and successive intermediate positions. The set of drops from the burst forms a swathe of width $\Delta X$ perpendicular to a relative forward direction Y of the print head and substrate. The print head is formed by means 116 to generate and break up ink jets into drops, charge electrodes 120,120', deflection electrodes 2,3;2',3' and gutter 6. This head is generally enclosed in a casing not shown. The time lapse between the impact of the first and last drop of a burst on the substrate is very short. This means that despite continuous movement between the print head and the substrate, it can be considered that the substrate has not moved relative to the print head during the printing time of a burst. The bursts are fired at regular spatial intervals. The combination of relative head and substrate movement and of the selection of drops from each burst which are directed towards the substrate enables the printing of any pattern.

Known print heads such as the one just described may comprise one or more ink ejection nozzles. When the head comprises several nozzles, the axes of these nozzles are generally parallel to one another.

According to an important characteristic of the invention, the axes of the two nozzles 31, 32 converge at a point A. The converging axes of nozzles 31, 32 define a plane. This plane contains the swathe of width $\Delta X$ perpendicular to the relative forward direction Y of the print head and of the substrate. In the advantageous embodiment shown in FIG. 1, deflection electrodes 2 and 2' are physically formed in a single electrode 2, called a central electrode. This central electrode is located between the so-called end electrodes 3 and 3'. The axes of nozzles 31, 32, the charge electrodes 120 120' and deflection electrodes 2,3,3' are arranged symmetrically relative to a plane perpendicular to the plane of the nozzle axes and contain a bisector of the angle formed by the axes of nozzles 31,32. This plane will hereinafter be called plane of symmetry. Gutter 6 to recover ink drops not used for printing is common to the drops derived from nozzles 31 and 32. The ink drops not used for printing reach a single orifice 61 of this common gutter 6. The ink drops not used for printing can, according to the embodiments of the invention, be either non-deflected drops in which case the centre of common orifice 61 coincides with convergence point A of the axes of nozzles 31, 32, or drops that are scarcely deflected in which case convergence point A of the axes of nozzles 31,32 is located upstream of said orifice 61. In the example shown in FIGS. 1 and 2, non-printable drops are non-deflected drops, and the convergence point of the axes of nozzles 31,32 substantially coincides with the centre of orifice 61 through which non-printable drops enter recovery gutter 6. In the example shown in FIG. 1, the drop generator 116 is a single chamber generator for both jets. A nozzle plate 117 closing the single chamber has symmetry relative to the plane of symmetry and forms a dihedron having the plane of symmetry as bisecting plane and whose angle is the supplement (180° complement) of the angle formed by the axes of nozzles 31,32. The nozzle axes are respectively perpendicular to each of the faces of this dihedron. This embodiment in which the junction drops derived from each of the jets are the non-deflected or least deflected drops is advantageous since the converging point of the pathways of the drops derived from the two nozzles, which is either converging point A of the axes of nozzles 31,32, or a point slightly downstream is independent or practically independent of voltage of the charge electrodes or of other parameters determining the charge and deflection of the drops. In addition, in this configuration gutter 6 may be placed closer to a downstream part and even, as will be seen below, upstream of the part that is most downstream from deflection electrodes 2,3,3'. In this manner the space requirement of head 30 is reduced. In FIG. 1, dotted lines show a few remarkable pathways of drops derived from nozzles 31,32. First pathways 9,9' respectively derived from nozzles 31,32 are the pathways of non-deflected drops. Having regard to high drop velocity, these pathways substantially coincide with the axes of nozzles 31,32 respectively. As explained above, these pathways converge at a point A which substantially coincides with the centre of orifice 61 of single gutter 6. Symmetrical pathways 5, 5' are also shown of the least deflected drops derived from nozzles 31,32 respectively. Pathways 5,5' converge at points B, B' respectively with substrate 27. Points B and B' have the same distance between them as the distance between two spatially consecutive drops from a burst. As explained above, since points B,B' are located at convergence points between substrate 27 and pathways of the least deflected printable drops, the relative positions of these points are little sensitive to variations in drop volume. On this account, the juncture between swathes traced by the drops derived from nozzles 31,32 respectively, is always of the same quality without the need to change the overall configuration of head 30. Two pathways 8, 8' are also shown of the most deflected drops derived from nozzles 31,32 respectively. The respective points of intersection C,C' of pathways 8,8' with print substrate 27 are symmetrical with one another relative to the plane of symmetry. Therefore swathes BC and B'C' are also symmetrical with one another relative to the plane of symmetry. They are located in the extension of one another. Therefore with the twin-nozzle head of the invention a swathe C' C can be produced that is twice the width of the one which can be produced by a head with a single nozzle, the swathe of double width having the same quality as a swathe of single width having regard to the quality of juncture between the two swathes of single width. It is observed that the plane of the axes of the jets contains all drop pathways. Since these pathways do not lie in different parallel planes, as in the case described in the above-cited patent application WO 91,11327, swathes B'C' and BC may be printed simultaneously. If the total width of double swathes C'C to be printed is less than twice the maximum height BC of the single swathes which can be produced by a jet derived from a single nozzle, it is then possible at least to double print speed in simple manner. Since points BB' are in the centre of the double swathe of reduced width, the duration of a burst of reduced amplitude is also reduced. Printing speed will be greater the smaller the swathe to be traced. It is to be noted that with the head described in above-cited patent WO 91,11327 for example, an increase in printing speed if the swathe is small is theoretically possible. However with said head if the duration of the burst from a head is reduced, in order to give consideration to a smaller height of each single swathe, the time offset between the firing of each of the bursts from the two nozzles must be reduced accordingly. This assumes the adaptation, not contemplated in this patent application, of the piloting electronic circuits to achieve variable offset in relation to the width of the single swathes.

According to an optional characteristic, which may be of advantage for some printing operations requiring one part with a first resolution and another part, a lower part for example, with a second resolution different to the first, the diameters of nozzles 31,32 may be of different values. It is known that ink drop volume and hence print resolution varies in relation to the frequency of jet break-off and the diameter of the ejection nozzle. For one same nozzle diameter, the higher the frequency the smaller the volume of the ink drop. For one same break-off frequency, the greater the nozzle diameter the greater the volume of the ink drop. Therefore through the accuracy of juncture between the printing made by the two nozzles it becomes possible to achieve prints of different resolutions from each nozzle.

Figure 2:
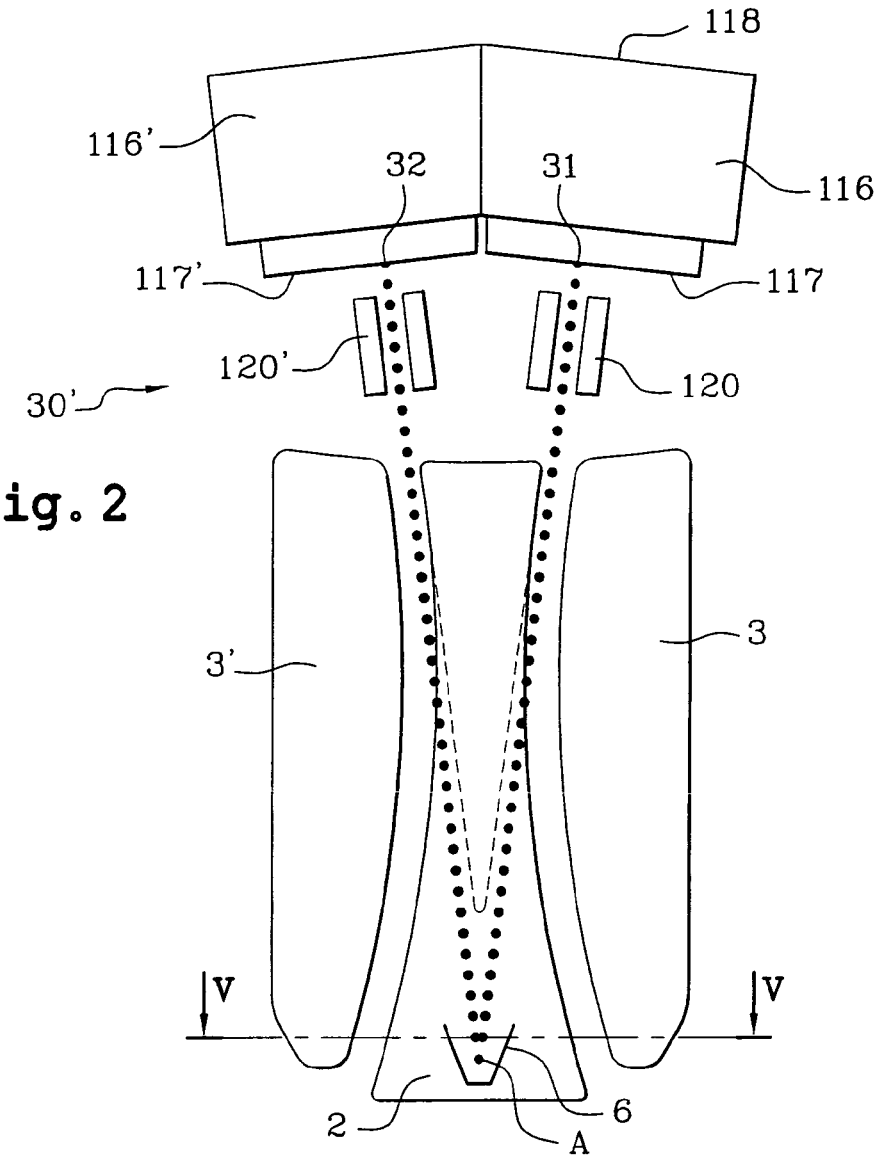
FIG. 2 is a schematic view along a direction perpendicular to the plane of the nozzle axes according to a second embodiment of a twin-nozzle printhead of the invention, this embodiment comprising a jet generation chamber per nozzle.
Figure 3:
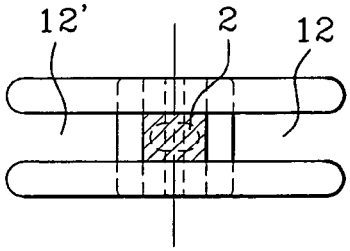
FIG. 3 is an underside schematic of a central deflection electrode common to the two jets of a twin-nozzle print head of the invention.
Figure 4:
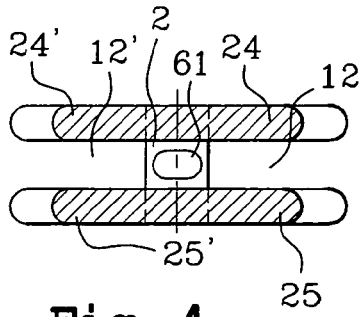
FIG. 4 is a schematic cross-section along line VV in FIG. 2 of the central deflection electrode shown in FIG. 3.

In the embodiment shown FIG. 1, a drop generator chamber 116 is common to both nozzles 31,32. In FIGS. 2, 3 and 4 a print head 30' is shown in which there is a drop generator 116,116' per nozzle. In known manner each generator is fitted with its own vibrator and its own nozzle plate 117,117' respectively. The axes of nozzles 31,32 are perpendicular to their respective nozzle plate 117,117' which together form an angle which is the supplement of the angle formed between the axes of said nozzles 31,32.

In the embodiments shown in relation to FIGS. 1 and 2, the deflection electrodes 2,3,3' may have the advantageous configuration detailed below. It is to be noted firstly that the deflection electrodes, in relation to the ejection nozzle of a jet, each have an upstream part which is a part close to the nozzle and a downstream part which is further distant from the nozzle. An active surface of each deflection electrode is defined as being a surface of said electrode which lies opposite the succession of drops. The active surfaces of the deflection electrodes in the advantageous embodiment are symmetrical relative to the plane of symmetry. Having regard to this symmetry our attention will be turned more particularly in the remainder of the description to the parts of electrodes 2, 3 lying opposite one another, anything said in relation to electrodes 2, 3 being valid symmetric fashion for the other half of electrode 2 and electrode 3'. In this advantageous embodiment, the active surface of first electrode 2 has a first concave longitudinal curvature whose local radius of longitudinal curvature is located in the plane defined by the axes of inkjet ejection nozzles 31,32. The active surface of the second electrode 3 has a first convex longitudinal curvature, and the first electrode 2 in its downstream part has a recess 12 having a contour 38. Recesses 12,12', symmetrical to one another relative to the plane of symmetry, of the first electrode are shown in an underside view in FIG. 3 and in cross-section along line VV of FIG. 2 in FIG. 4. These figures show that the slits 12,12' lie between two tongues 24,25;24',25' respectively. They also show that the inlet orifice 61 of gutter 6 is housed in a central part of first electrode 2. This orifice 61 is of oblong shape in a direction perpendicular to the plane of symmetry, its centre lying in this plane of symmetry.

In its widest part, the size of orifice 61 is between 10 and 30 times the diameter of nozzles 31,32 and preferably 20 times this diameter.

In its longest part, the size of orifice 61 is between 30 and 80 times the diameter of nozzles 31,32 and preferably 50 times.

For example for a nozzle of 50 μm in diameter, the width of the orifice is typically 1 mm and its length 2.5 mm.

Figure 5:
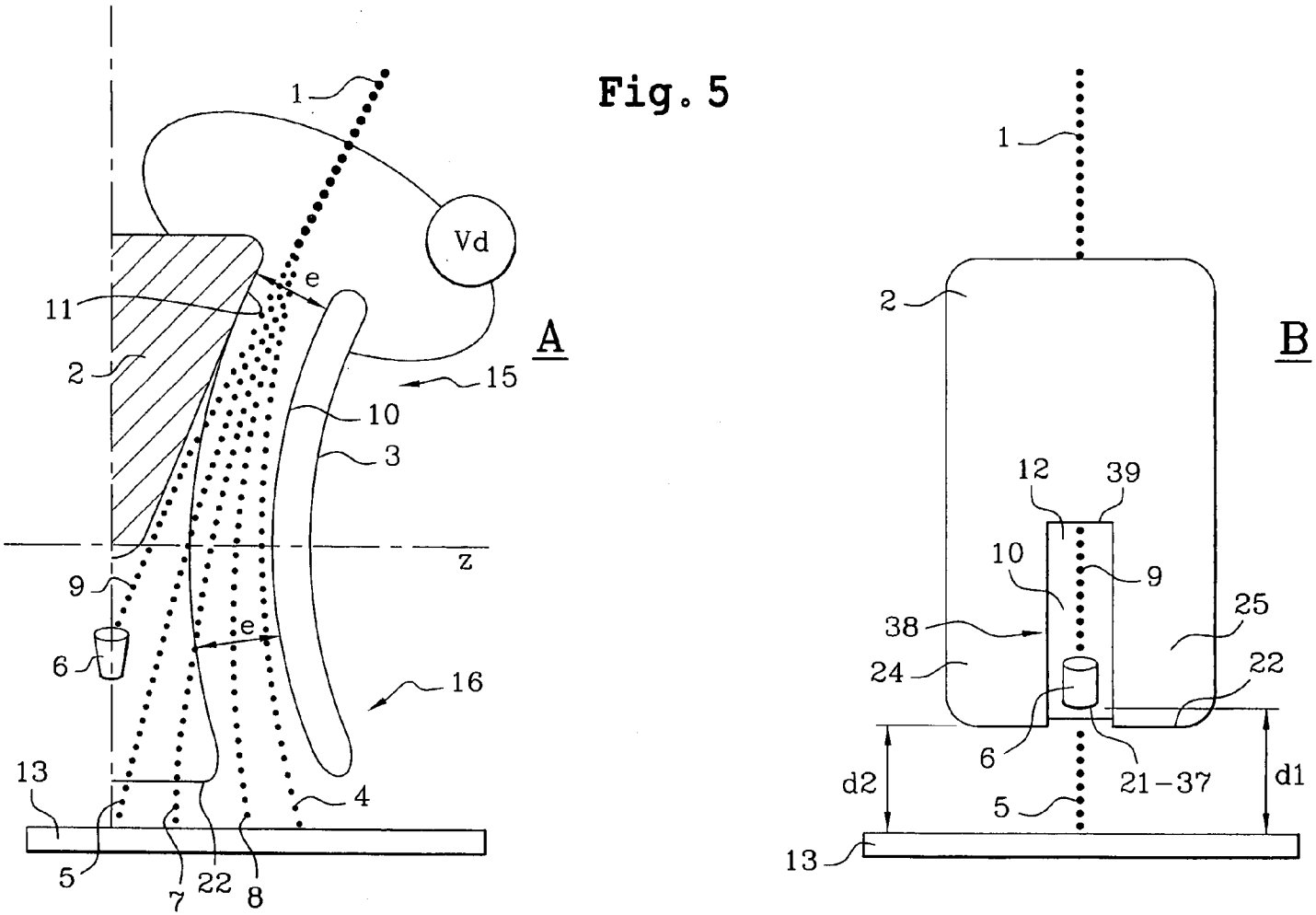
FIG. 5 comprises parts A, B and C.
Figure 5:
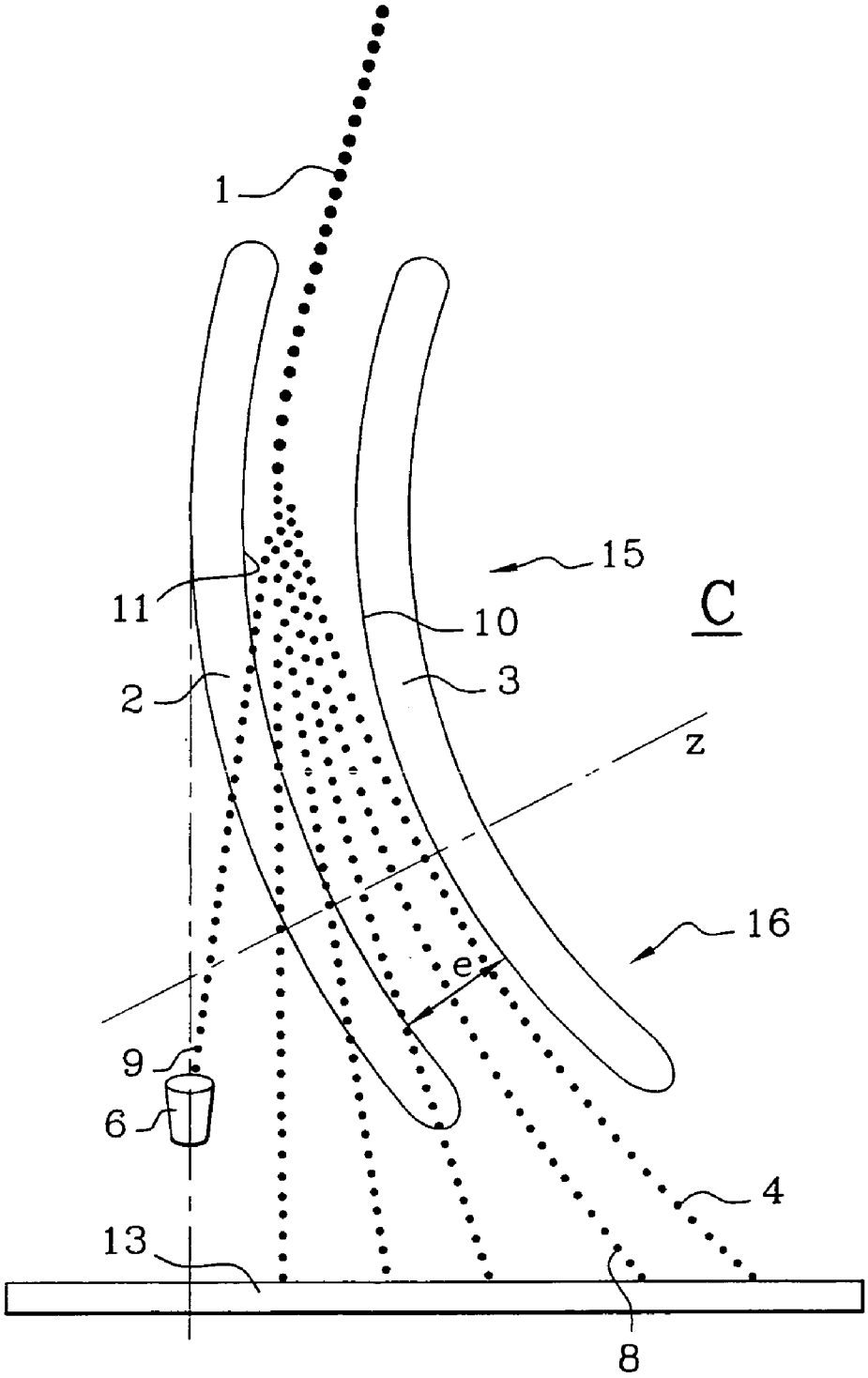
Figure 7:
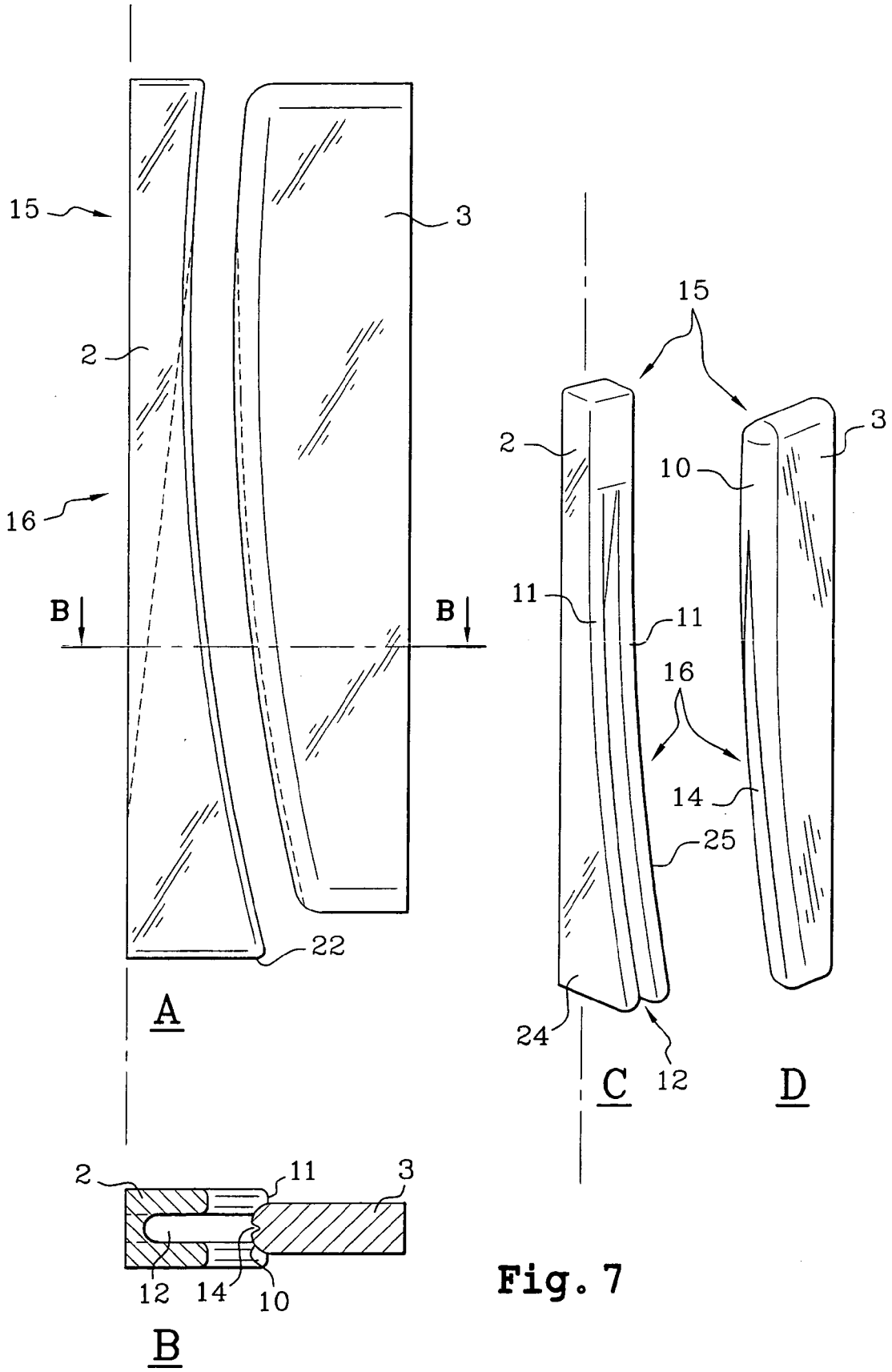
FIG. 7 comprises parts A, B, C and D. Part A is a perspective side semi-view of an assembly of two electrodes according to the advantageous embodiment of the deflection electrodes. Part B shows a semi cross-section view of two electrodes along line B—B in part A. Part C is a semi perspective view of a slit electrode according to an embodiment of the invention. Part D is a perspective view of the convex electrode intended to show a surface indent.

FIGS. 5 and 6 parts A and B are respectively a front semi-schematic and a left-side view illustrating a particular embodiment of electrostatic deflection electrodes according to the advantageous embodiment of the electrodes implemented within a deflection continuous inkjet print head with twin nozzle. These figures are intended to explain the advantageous embodiment of the deflection electrodes and its functioning. FIG. 7 is intended to show the shape of the electrodes in more realistic manner in a variant of this advantageous embodiment. FIGS. 5–7 only show the parts related to the electrodes that are the subject of the advantageous embodiments.

A succession of selectively charged drops 1 enters into the space delimited by electrodes 2 and 3 between which there is a potential difference Vd supplied by a voltage generator not shown. Electrodes 2 and 3 are of substantially equal height. A plane tangential to the active surfaces of electrodes 2 and 3 respectively in their most upstream part is parallel to the axis of the jets or secant to this axis at a small angle.

An active surface 11 of first electrode 2 has a concave longitudinal curvature substantially opposite that of active surface 10 of second electrode 3. An active surface 10 of electrode 3 has a convex longitudinal curvature such that this surface, in a downstream part, lies substantially parallel to pathway 4 shown by a dotted line of the most deflected drops. In known manner, a pathway may be visualized by strobe lighting of the drops.

Space e separating surfaces 10 and 11 is substantially constant over the entire height of electrodes 2,3. The value of space e is less than 3.5 mm, preferably less than 2 mm. So as not to hinder the pathways of the least charged drops, a recess 12 which in the example shown is in the shape of a slit 12, visible in part B of FIG. 5 and parts B and C of FIG. 7, is made in the downstream part of electrode 2. The width of recess 12 is greater than the diameter of the ink drops. In practice, the width of the recess is advantageously limited so that the fall in value of electric field Ed existing in the downstream part of electrodes 2,3 does not exceed 15% of the value of the optimal field set up in its upstream part. The value of the electric field Ed set up between the active surfaces of electrodes 2,3 is called optimal when this value is slightly lower, by subtraction of a safety margin, than the value of the breakdown field corresponding to the space e between the active surfaces.

According to an embodiment shown in part C of FIG. 5, central electrode 2 is replaced by two central electrodes 2,2' symmetrical to one another relative to the plane of symmetry. In the semi-view of FIG. 5 part C only electrode 2 is shown. Each of the two electrodes is in the form of a metal sheet preferably having a transverse curvature in addition to the longitudinal curvature. The two sheets in their downstream part have a slit enabling drops to pass through the electrode. The two sheets are at the same potential.

Electrodes 2 and 3 are preferably made in a stainless metal.

The longitudinal curvature of the electrodes is preferably constant, so that the active surfaces of electrodes 2, 3 are substantially formed by cylindrical surface parts having an axis perpendicular to the plane of the axes of nozzles 31,32.

Functioning is as follows.

The electric field Ed arising from the potential difference Vd deflects the ink drops proportionally to their electric charge along predefined pathways. Pathway 4 is the one followed by the drops carrying a maximum charge Qmax. It is therefore the pathway of the drops that are most deflected. Active surface 10 of second electrode 3 is calculated so that the probability of collision between pathway 4 and the second electrode is practically zero, even though pathway 4 is parallel and close to active surface 10 of second electrode 3 at least in a downstream part of this surface. Pathway 5 is the one followed by the drops carrying a minimum charge Qmin enabling avoidance of recovery gutter 6 and therefore enabling the drops carrying this minimum charge Qmin to be directed towards print substrate 27. As shown FIG. 1, symmetrical pathways 5,5' of the drops the least deflected used for printing are those of the drops forming the junction between the swathes traced by each of the nozzles. These are the shortest pathways and the least likely to be disturbed. In this way good quality junction is obtained. The drops carrying electric charges lying between values Qmax and Qmin follow intermediate pathways such as pathways 7 or 8 for example. Pathway 9 corresponds to the pathway of drops carrying a charge of less than Qmin: said drops are captured by recovery gutter 6 and recycled towards an ink circuit of the printer.

Slit 12 shown FIG. 5 part B and FIG. 7 parts B and C is, as explained above, such that the least deflected drops in particular those carrying a charge of less than Qmin pass through this slit. As a result, a part 39 which is the most upstream part of a contour 38 of this slit 12, is located at a point close to the point of intersection of the jet axis with first electrode 2. Since the drops with a charge of less than Qmin and the least charged drops of those carrying a charge of between Qmin and Qmax, pass through slit 12 of electrode 2, the angular dispersion of the drops which will impact the different points of the swathe to be traced, may be maintained despite a space e between electrodes 2 and 3 that is smaller compared with electrodes of the prior art.

The narrowness of space e allows use of a value Vd in the order of 3 kV instead of 8 or 10 kV usually used in equipotential electrode devices of the prior art. It is therefore particularly advantageous to obtain the potential difference Vd by bringing electrode 2 to the reference potential of the ink, usually the earth potential of the printer. Under these conditions, unlike the prior art in which this potential is an opposite potential of electrode 3, relative to the ink potential, it becomes possible to position closer or even to integrate recovery gutter 6 and electrode 2 as shown FIGS. 2, 4, 5 without risk of electric breakdown between these two parts and without deteriorating field Ed between the two electrodes 2 and 3.

Under these conditions, the distance d1 between a lower edge 21 of gutter 6 and print medium 13 may be greater than distance d2 separating a downstream end 22 of electrode 2 from this same print medium 13. This brings a substantial reduction in the pathway travelled by the drops directed towards gutter 6 and hence a reduction in the probability of non-attainment of this gutter by these drops. It is noted in this embodiment that the most downstream edge 22 of the deflection electrode is more downstream than surface 21 that is most downstream of gutter 6.

Parts A and B of FIG. 6 and part D of FIG. 7 each illustrate an advantageous variant of the advantageous embodiments of electrodes 2 and 3. Each of these embodiments is illustrated FIG. 6 by a large-scale cross-section approximately following plane z defined in FIG. 5 part A. The form of the intersection curves between the surfaces of electrodes 2,3 with the plane of section may, over their entire height or at least in a downstream part, characterize the active faces 10 and 11.

Sections via plane z are given downstream of point 39 the most upstream of slit 12 shown in FIG. 5 part B. As explained above in connection with FIGS. 3 and 4, slit 12 separates semi-electrode 2 into two tongues 24 and 25 respectively. FIG. 6 is intended to show that advantageously tongues 24,25 and electrode 3 lying opposite to them have transverse curvatures. These transverse curvatures are also visible FIG. 7.

The objective of the transverse curvatures illustrated in FIG. 6 part A is to eliminate any sharp metallic edge or roughness likely to generate a phenomenon of electric discharge which could weaken field Ed or lead to electric breakdown. The transverse curvature radius of surface 11 of tongues 24 and 25 and of electrode 3 is at all points greater than the radius of the ink drops.

FIG. 6 part B shows an electrode 2 having the same transverse curvature characteristics as electrode 2 shown in part A. According to one variant of embodiment shown part B, the active surface 10 of electrode 3 also has a transverse curvature having the same capacities as electrode 3, shown part A, in reducing the onset of electric discharges.

Electrode 3 also has a longitudinal indent or groove 14. This indent may extend over the entire height of surface 10 or only over a downstream part as illustrated FIG. 7 parts B and D. Indent 14 is positioned transversally, opposite recess 12 of electrode 2. The width of indent 14 is greater than the diameter of the ink drops but remains sufficiently narrow so as not to move field Ed too far away from its optimal value.

Said indent is particularly useful for avoiding certain ink sprayings onto active surface 10 of electrode 3. Should the ratio between electric charge and the volume of some drops be ill-controlled and exceed a predetermined maximum value, these drops follow a wrong pathway 35 and:

enter indent 14 without colliding with surface 10, inside indent 14, undergo the action of a very weak electric field.

This fall in the field value causes stabilisation of the erroneous pathways and, at the exit of the deflection device, maintains them on pathway 4 of the most deflected drops whose charge to volume ratio meets the predetermined maximal value. Even though they have an erratic pathway, these drops do not collide with electrode 3. On this account electrode 3 remains clean which means that it is not deformed by the presence of ink on the electrode. Consequently, the following drops will not undergo any pathway deformations due to the possible presence of a drop having an erratic pathway. This arrangement also has the advantage of facilitating adjustments of voltage to be applied to the electrodes when powering up the printer.

The advantages of this advantageous embodiment of the invention and its variant over the prior art are clear:

simultaneous achievement of design simplicity and deflection efficiency, protection against certain ink sprayings onto the electrodes by adjusting the geometry of at least one active surface.

The low value of Vd and the high positioning of recovery gutter 6 provide for a marked reduction in print head space requirements and the pathway travelled by the ink drops. Parasite variations in drop pathways are consequently of small amplitude and print quality is improved.

APPENDIX

List of Relevant Prior Art Documents

1) WO 91/05663 (U.S. Pat. No. 5,457,484)
2) WO 91/11327

The invention claimed is:

1. Twin-nozzle print head for a continuous inkjet deflection printer, the print head comprising:

an ink drop generator assembly having two inkjet ejection nozzles, each of the inkjet ejection nozzles having an ejection axis, and arranged along the ejection axis:

charge electrodes, first and second deflection electrodes deflecting charged drops, these deflection electrodes each having relative to said inkjet ejection nozzles an upstream part and a downstream part, an active surface of each deflection electrode being a surface of said electrode lying opposite a succession of drops, a single ink drop recovery gutter for both said inkjet ejection nozzles, wherein the ejection axes of said inkjet ejection nozzles converge at a point located on an axis of a single inlet orifice of the single recovery gutter, the point being in the vicinity of this inlet orifice or upstream of this recovery gutter.

2. Twin-nozzle print head as in claim 1, having a plane of symmetry which is a plane perpendicular to a plane defined by the converging ejection axes of the inkjet ejection nozzles and containing a bisector of the angle formed between said converging ejection axes of the inkjet ejection nozzles.

3. Twin-nozzle print head as in claim 2, wherein the first deflection electrode deflecting charged drops is a first electrode common to the drops derived from the inkjet ejection nozzles, this common deflection electrode for charged drops being located between the second deflection electrodes for charged drops.

4. Twin-nozzle print head as in claim 1, where the first deflection electrode deflecting charged drops is a first electrode common to the drops derived from the inkjet ejection nozzles, this common deflection electrode for charged drops being located between the second deflection electrodes for charged drops.

5. Twin-nozzle print head as in claim 1, wherein the active surface of the first deflection electrode deflecting drops from a jet has a first concave longitudinal curvature whose local radius of longitudinal curvature is located in the plane formed by the converging ejection axes of the inkjet ejection nozzles, in that the active surface of the second deflection electrode deflecting drops from said same jet has a first convex longitudinal curvature, and in that the first deflection electrode deflecting drops from said jet, in its downstream part, has a recess having a contour.

6. Twin-nozzle print as in claim 5, wherein said contour has a most upstream point located in the vicinity of the intersection before said recess of said first deflection electrode deflecting said jet, with the ejection axis of said inkjet ejection nozzle of said jet.

7. Twin-nozzle print head as in claim 5, that wherein the recess has symmetry relative to the plane defined by the converging ejection axes of the inkjet ejection nozzles.

8. Twin-nozzle print head as in claim 5, wherein the width of recess ranges between two and 10 times the diameter of the charged drops.

9. Twin-nozzle print head as in claim 5, wherein the recess is in the form of an oblong slit of which one opening leads to a part which is the most downstream of first electrode.

10. Twin-nozzle print head as in claim 5, wherein the space between the active surfaces of deflection electrodes deflecting a jet derived from one of the inkjet ejection nozzles is substantially constant from upstream to downstream of the electrodes and lies between 4 and 20 times the diameter of the charged drops.

11. Twin-nozzle print head as in claim 5, wherein the second deflection electrode deflecting an inkjet has a groove along an axis contained in the plane defined by the converging ejection axes of the inkjet ejection nozzles.

12. Twin-nozzle print head as in claim 11, wherein a bottom of groove is joined to the active surface of said second electrode via a surface curved transversely along curve radii of greater value than the radius of the charged drops.

13. Twin-nozzle print head as in claim 5, wherein tongues of said first deflection electrode deflecting a jet formed either side of the recess and second deflection electrode deflecting the same jet are curved transversely along curve radii of greater value than the radius of the charged drops.

14. Twin-nozzle print head as in claim 5, wherein the inkjet ejection nozzles have different diameters.

15. Twin-nozzle print head as in claim 5, wherein orifice of the recovery gutter is of oblong shape.

16. Twin-nozzle print head as in claim 1, wherein one most downstream edge of a first deflection electrode is more downstream than a surface that is most downstream of recovery gutter.

17. Printer equipped with a twin-nozzle print head according to any of the preceding claims.

18. Twin-nozzle print head for a continuous inkjet deflection printer, said print head comprising:

an ink drop generator assembly having two inkjet ejection nozzles, each of the inkjet ejection nozzles having an ejection axis, these ejection axes converging at a point located on an axis of a single inlet orifice of a single ink drop recovery getter, the point being in the vicinity of this inlet orifice or upstream of this recovery gutter, charge electrodes arranged along the ejection axis of the inkjet ejection nozzles, a plurality of deflection electrodes each having relative to inkjet ejection nozzles an upstream part and a downstream part, and each having an active surface which is a surface said deflection electrode lying opposite a succession of drops, the plurality of deflection electrodes comprising a first deflection electrode and second deflection electrodes, the first deflection electrode arranged along the ejection axis of the inkjet ejection nozzles and deflecting charged drops, said first deflection electrode being common to the drops derived from the inkjet ejection nozzles, having a recess having a contour in the downstream part, and the active surface of the first deflection electrode having a first concave longitudinal curvature whose local radius of longitudinal curvature is located in the plane formed by the converging ejection axes of inkjet ejection nozzles, and the second deflection electrodes arranged along the ejection axis of the inkjet ejection nozzles and deflecting charged drops, the active surface of which having a first convex longitudinal curvature, the common deflection electrode for charged drops being located between the second deflection electrodes for charged drops.

19. Twin-nozzle print head as in claim 18, wherein the recess is in the form of an oblong slit of which one opening leads to a part which is the most downstream of first electrode.

20. Twin-nozzle print head as in claim 19, wherein the recess has symmetry relative to the plane defined by the converging ejection axes of the inkjet ejection nozzles.

* * * * *